United States Patent [19]

Freese

[11] 4,133,392

[45] Jan. 9, 1979

[54] CUSHION LINK AND HYDRAULIC STABILIZER FOR BULLDOZER BLADE

[75] Inventor: Gary P. Freese, Joliet, Ill.

[73] Assignee: Caterpillar Tractor Co., Peoria, Ill.

[21] Appl. No.: 837,965

[22] Filed: Sep. 29, 1977

[51] Int. Cl.[2] ..... E02F 3/76

[52] U.S. Cl. ..... 172/809; 280/481; 267/153; 267/22 A; 267/11 A

[58] Field of Search ..... 172/801, 804, 803, 806, 172/809; 280/112 A, 112 R, 481; 267/11 A, 35, 64 B, 63 R, 153, 22 A, 63 A

[56] References Cited

U.S. PATENT DOCUMENTS

| | | | |
|---|---|---|---|
| 1,647,518 | 11/1927 | Hawley | 267/11 A |
| 3,158,944 | 12/1964 | Rehberg | 172/803 |
| 3,265,380 | 8/1966 | Hall | 172/801 |
| 3,437,332 | 4/1969 | Lee | 267/135 |
| 3,441,092 | 4/1969 | Drone | 172/803 |
| 4,074,896 | 2/1978 | Eftefield | 172/803 |

*Primary Examiner*—Richard J. Johnson

*Attorney, Agent, or Firm*—Wegner, Stellman, McCord, Wiles & Wood

[57] ABSTRACT

A bulldozer blade mounting assembly is provided for mounting a bulldozer blade on the front of a tractor. The mounting assembly includes a push frame connected between the tractor and the lower portions of the blade. A combined cushioning and stabilizing linkage assembly is provided with a link extending diagonally between each push arm of the push frame and the upper rear corner portions of the blade. The stabilizers on each link are interconnected with a closed loop hydraulic system so as to ensure that any deflection in one link must also occur in the opposite link.

13 Claims, 6 Drawing Figures

CUSHION LINK AND HYDRAULIC STABILIZER FOR BULLDOZER BLADE

BACKGROUND OF THE INVENTION

1. Field of the Invention

This invention relates to tractor-mounted bulldozer blades and, more particularly, to a combined cushioning and hydraulic stabilizing linkage for said blade.

2. Description of the Prior Art

In certain uses of tractor-mounted bulldozer blades, it is desirable that the loading of the blade be maintained substantially uniform across the width of the blade while still having some cushioning of the blade to absorb some of the shock administered to the blade when the blade makes contact, for instance, with a push block of a scraper.

There are currently available bulldozer blade-mounting assemblies employing hydraulic cylinders between the push frame and the blade, but, the assembly does not include any cushioning arrangement whereby shocks on the blade can be absorbed without being transmitted through the push frame to the tractor.

In another known device, the bulldozer blade has separate cushioning means and tilt cylinders mounted between the blade and the tractor. The tilt cylinders function to tilt the blade for certain purposes while the separate cushioning means serve to absorb shock loads on the blade.

These prior devices, although completely effective for their intended use, do require separate elements for cushioning and for stabilizing, which increases the number of parts, adds expense, and increases the complexity of building and maintaining the equipment.

SUMMARY OF THE INVENTION

The present invention is directed to overcoming one or more of the problems set forth above.

According to the present invention, an improved linkage assembly is provided for a cushioned bulldozer blade. The linkage is used to replace the tilt cylinders and to replace a separate cushioning means between the blade and the tractor. The combined cushioning and stabilizing linkage assembly has a pair of links, with each link positioned on a diagonal between the push frame and the blade. Each link has resilient or spring members for cushioning shocks received by the bulldozer blade and has a hydraulic cylinder portion with the hydraulic portions of the pair of links cross connected such that the two links operate together to equalize and stabilize the loads on the blade.

The improved combined cushioning and stabilizing linkage assembly reduces the complexity of the blade mounting system, thereby making it less expensive to build and to maintain.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 2*a* is an exploded partial perspective view of the assembly of the fixed wall in the link;

DESCRIPTION OF THE PREFERRED EMBODIMENT

Figure 1:
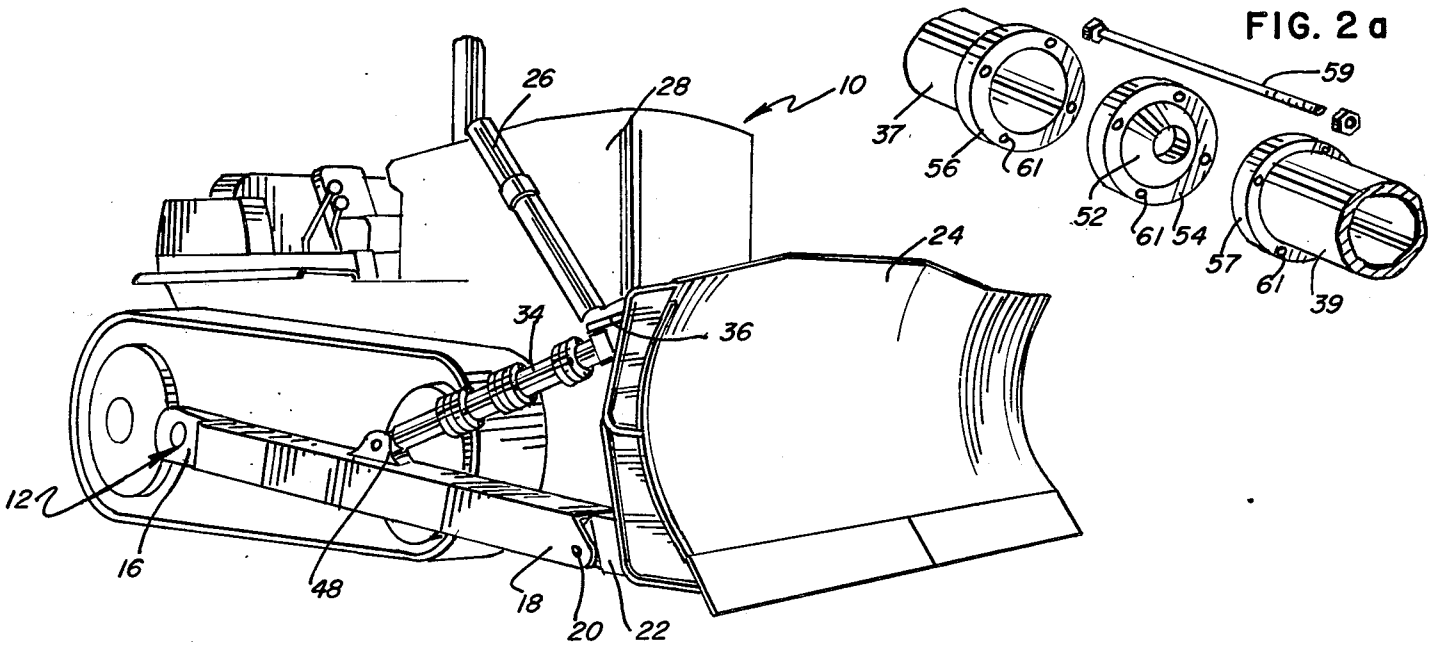
FIG. 1 is a perspective view of a tractor with a cushion bulldozer blade and a linkage assembly incorporating the combined cushioning and stabilizing apparatus of the invention.
Figure 4:
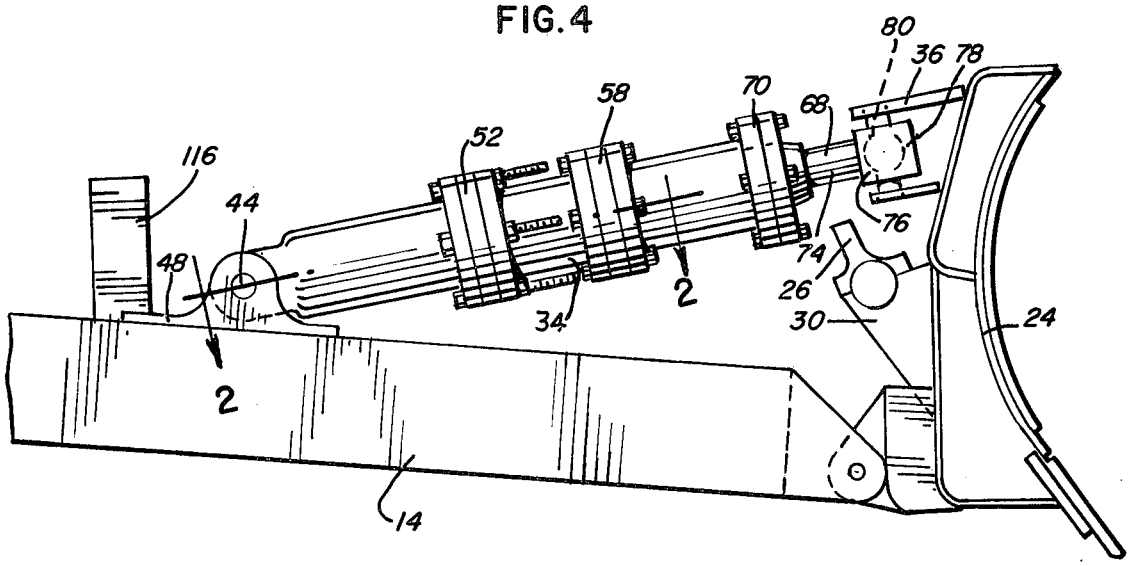
FIG. 4 is an elevational view of the apparatus of FIG. 3.

Referring generally to FIG. 1 of the drawings, a tractor 10 is illustrated and has a track roller frame 12 operatively connected thereto. A push arm 14 of a push frame is shown connected by means of a trunnion and bearing assembly 16 to the track roller frame 12 at one end portion thereof, with the other end portion of the arm 14 having a bifurcated extension 18 pivotally connected by a pin 20 to a lug 22 carried by the bottom rear corner of the bulldozer blade 24. A second push arm 14 is mounted on the opposite side of the tractor 10 with the two push arms making up the push frame. A pair of lift cylinders 26, only one of which is shown, are connected between the tractor main frame 28 and a pair of brackets 30 (FIG. 4) on the rear of the bulldozer blade 24 and are used for raising and lowering the blade 24 relative to the ground. A combined cushioning and stabilizing linkage assembly 32 has a pair of links 34 on each side of the tractor 10 with each link 34 being pivotally mounted at one end portion to the push arm 14 and being pivotally mounted at its other end portion to a pair of spaced apart brackets 36 carried by the upper rear corner portions of the bulldozer blade 24.

FIGS. 2 through 5 will now be referred to and, in particular, with reference to the details of the combined cushioning and stabilizing link 34. For the present purpose, only one link 34 will be described, but it is understood that each link 34 connected between the push arms 14 and the blade 24 on each side of the tractor 10 are identical in construction.

Figure 2:
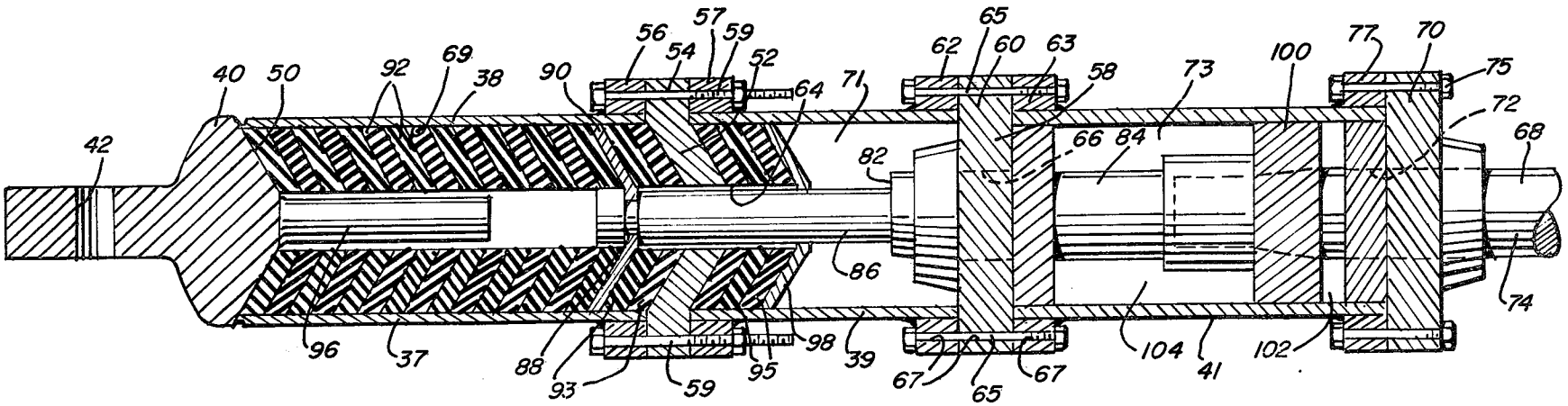
FIG. 2 is an enlarged cross-sectional view taken along the line 2—2 of FIG. 4.
Figure 3:
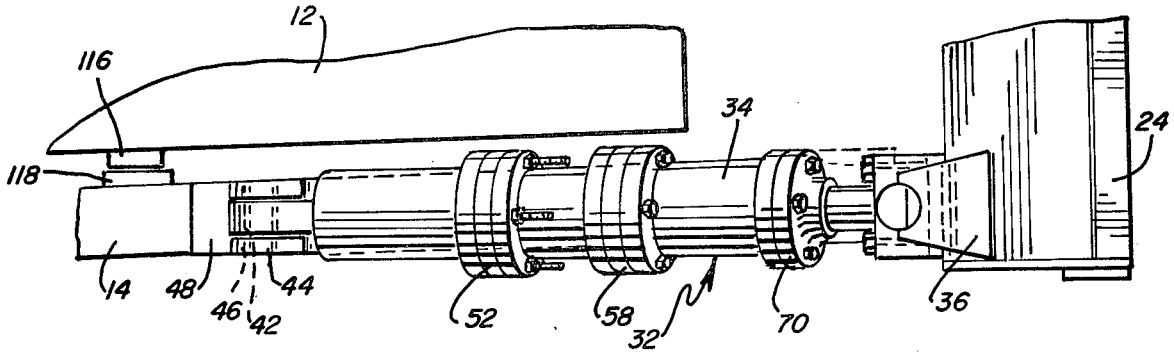
FIG. 3 is a plan view of one link of the linkage assembly showing the connection between the push frame and the bulldozer blade.

The link 34 is comprised of a cylinder 38 which is divided into three portions, a cushioning portion 37, a midportion 39 and a hydraulic portion 41. A mounting cap 40 is either welded or integrally formed on the cushioning portion 37 of the cylinder 38. The mounting cap 40 has an eye 42 extending transversely therethrough, which eye 42 receives a pin 44 passing through aligned apertures 46 in upstanding spaced apart walls of a bracket 48 welded or otherwise secured to the top surface of each push arm 14. Longitudinally spaced from a conically-shaped inside wall 50 of the mounting cap 40 is a fixed wall 52 which, as shown in FIG. 2, is disc-shaped and includes a flange portion 54 extending radially outwardly beyond the walls of the cylinder between the cushioning portion 37 and the midportion 39. A ring 56 is welded on the end of the cushioning portion 37 and a second ring 57 is welded on the end of the midportion 39, said rings being juxtaposed on opposite sides of the flange 54 of the fixed wall 52. A plurality of elongate bolts 59 pass through aligned openings 61 in the rings 56, 57 and fixed wall 52 in a manner to be described hereinafter. A second fixed wall 58, longitudinally spaced from the first fixed wall 52 is positioned between the midportion 39 and the hydraulic portion 41 of the cylinder 38 and has a flange portion 60 extending beyond the walls of the cylinder 38. A ring 62 is welded to the end of the midportion 39 with a second ring 63 being welded to the end of the hydraulic portion 41. The rings 62, 63 are juxtaposed on opposite sides of the flange 60 with bolts 65 passing through aligned openings 67 in said rings 62, 63 and flange 60 and being drawn up tight to securely fix the wall 58 relative to the cylinder 38. The fixed walls 52 and 58 have centrally disposed, aligned apertures 64 and 66, respectively, with aperture 66 having a larger diameter for a purpose to be described hereinafter. The fixed walls 52 and 58 divide the cavity in the cylinder 38 into three chambers, a cushioning chamber 69, a bottoming chamber 71 and a hydraulic chamber 73.

An elongate actuating rod 68 extends through an apertured end cap 70 which is secured by bolts 75 to a ring 77 welded to the end of the cylinder 38. The rod 68 extends through an aperture 72 in the end cap 70 and projects into the cylinder 38. The extended end portion 74 of the rod 68 has a crutch 76 engaging with a dumbbell 80 carried by the bracket 36 mounted on the blade 24. A cap 78 is bolted to the crutch 76 to secure the rod 68 to the blade 24 with a universal connection to permit movement between the links and the blade without binding.

The rod 68 passes through the aperture 72 in the cap 70 and through the fixed wall 58. Beyond the wall 58, the diameter of the rod 68 becomes smaller forming a shoulder 82 between the large diameter portion 84 and the small diameter portion 86. The small diameter portion 86 extends through the fixed wall 52 and has an undercut portion 88 in which is seated a disc-shaped cushioning piston 90. The concave side of the disc-shaped piston 90 faces the convex side of the conical wall 50 on the cap 40.

A plurality of disc-shaped or frustoconically-shaped cushion elements 92 are stacked one against the other in the cushioning chamber 69 of the cylinder 38 with the apertures 94 in the discs or elements 92 aligned with each other. The discs or elements 92 are made of a resilient material, such as rubber, and would have a high durometer hardness. The one end disc 92 bears against and mates with the conical surface 50 on the cap 40 with the disc 92 on the opposite end of the stack mating with the conical shape of the piston 90.

Additional discs or elements 93, two being shown, fit between the piston 90 on the rod 68 and the fixed wall 52. With the uncompressed discs 92 and 93 stacked in the chamber 69 in the cushioning portion 37 of the cylinder 38, the piston 90 and the fixed wall 52 are located axially outside the end of the cushioning chamber 69. The elongate bolts 59 are threaded through the openings 61 in the ring 56, in the flange 54 of the fixed wall 52 and in the ring 57 on the midportion 39 whereupon nuts are threaded on the bolts 59 and are drawn up to compress the discs 92 and 93. When the nuts on the bolts 59 are drawn up tight so as to abut the rings 57 and 56 against the flange 54 of the wall 52, the discs 92, 93 will be preloaded the desired amount. Increased or decreased preloading can be affected by increasing or decreasing the number of discs 92 and/or 93 inserted in the chamber 69. A cylindrically-shaped stop 96 is anchored to the conical surface 50 of the end cap 40 and projects through the aligned apertures 94 in the discs 92, 93 toward the end of the rod 68. With the discs 92 assembled, as shown, a space is provided between the stop 96 and the rod 68 for a purpose to be described hereinafter.

A disc-shaped plate 98 encircles the small diameter portion 86 of the rod 68 in the chamber 71 of the midportion 39 of the cylinder 38 and is held separated from the fixed wall 52 by a plurality of resilient discs or elements 95, three discs 95 being shown in the drawing. The plate 98 is spaced from the shoulder 82 on the rod 68 when the resilient discs or elements 92 in chamber 69 are in the static condition of FiG. 2. The large diameter portion 84 of the rod 68, where it passes through the aperture 66 in the second fixed wall 58, is intended to be a fluid-tight sliding connection so that the area on opposite sides of the second fixed wall 58 are substantially sealed from each other. The large diameter portion 84 of the rod 68 has a hydraulic piston 100 rigidly secured thereto, which piston 100 is disposed in the chamber 73 of the hydraulic portion 41 of the cylinder 38 which portion is formed by the end cap 70 and the second fixed wall 58. The piston 100 being fixed to the rod 68 will be moved with the rod in said chamber 73 and divides the chamber into a rod end 102 and a head end 104.

Figure 5:
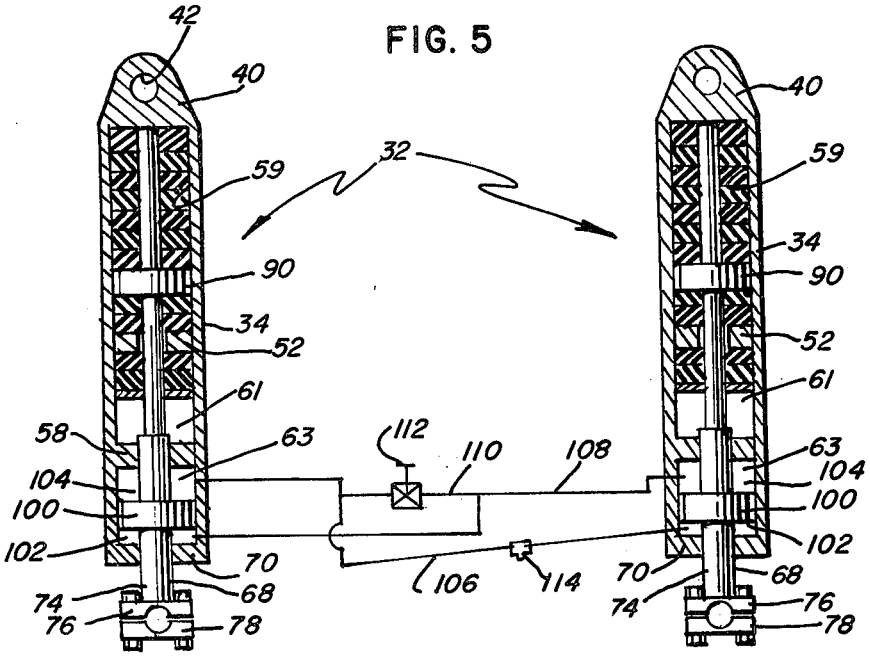
FIG. 5 is a schematic showing of the two links and the hydraulic interconnection therebetween.

As shown in FIG. 5, the hydraulic pistons 100, 100 in the chambers 73, 73 are plumbed in such a way that the head end 104 of the piston 100 is the right-hand link 34 is connected through tubing 108 to the rod end 102 of the piston 100 in the left-hand link 34. Also, the rod end 102 of the right-hand link 34 is connected by tubing 106 to the head end 104 of the chamber 73 on the left-hand link 34. The two tubes 106, 108 are interconnected by a bypass tube 110, which bypass 110 contains a valve 112 for shutting off the flow therebetween. A filling valve 114 is provided in tube or line 106 through which hydraulic fluid is added to the system initially, or when needed to replace lost fluid. The valve 112 is opened when the system is being filled or when equalizing or balancing the system.

With the two links 34 connected between the push arms 14 of the push frame and the upper rear corners of the blade 24, a linkage assembly is provided which, not only cushions the blade 24, but also stabilizes the blade. That is, a blow on the blade 24 slightly off-center will depress both links 34 with the shock of the blow being transmitted through the rods 68 to the pistons 90 in the chambers 69, which will compress the stack of resilient elements or discs 92 in the chambers 69. In the event the shock is excessive, the shoulder 82 on the rod 68 will engage with the plate 98 and compress the resilient discs 95 between the plate 98 and the fixed wall 52 to provide a resilient bottoming of the blade. If the shock is so severe as to extensively compress the discs 95 and discs 92, the rod 68 will bottom by engaging the stop 96 on the cap 40 to prevent crushing of the discs 95 and 92 beyond recovery. To prevent damage caused by rebound of the discs 92 and sometimes discs 95, the discs 93 between piston 90 and wall 52 will absorb any tendency for the rod 68 to be driven too rapidly to the right (in FIG. 2) upon recovery of the compression of the discs 92 and sometimes discs 95.

In the meantime, the pistons 100 will attempt to compress the hydraulic fluid in the head ends 104 of the pistons 100 and, since the blow was assumed to be offcenter, one piston 100 will have excessive pressure over the other piston 100 which will cause fluid to flow from the head end 104 of the higher pressure side through the tubing to the rod end 102 of the opposite piston 100 adding further force to the piston 100 on the deficient side of the system. Independent forces will act on each link so as to produce a given deflection in each link which deflection will be equal on each link. Any tendency for an imbalance of deflection on one link will immediately be compensated for by the hydraulic system to restore a balance of deflections to both links.

The discs 92 and 95 are preloaded between the cap 40 and the fixed wall 52 which will keep the lengths of the links 34 constant under no load condition and will compensate for some leakage of hydraulic fluid past the pistons 100.

A wear plate 116 is mounted on the side of each track roller frame 12 with each plate being in alignment with a wear shoe 118 mounted on the inside of each push arm 14 of the push frame. The wear plate 116 and wear shoe 118 cooperate to provide some lateral stability to the push frame and blade 24.

The embodiment of the invention in which an exclusive property or privilege is claimed is defined as follows:

1. A tractor having a bulldozer blade, a push frame having a pair of push arms, each push arm being connected to said tractor and to a lower corner of said blade, a link extending between each push arm and an upper corner of said blade, each link having a cylinder with a cavity, a pair of spaced apart apertured walls in said cylinder dividing the cavity into three separate chambers, a rod extending into said cavity, said rod having a cushioning piston and a hydraulic piston secured thereto with the cushioning piston disposed in one end chamber and the hydraulic piston disposed in the other end chamber, cushioning means in said one end chamber for cushioning loads applied to said rod by said blade, hydraulic means connecting the head ends and rod ends of the respective hydraulic pistons in series whereby excess loads on the rod of one link will be transmitted through the hydraulic means to the hydraulic piston in the other link to stabilize the loads received by the links from the blade.

2. A tractor as claimed in claim 1 wherein said cushioning means comprise a plurality of resilient elements disposed between said cushioning piston and one end portion of said cylinder.

3. A tractor as claimed in claim 1 wherein rebound means are provided between said cushioning piston and one of said apertured walls to cushion any rebound of the rod caused by said cushioning means.

4. A tractor as claimed in claim 1 wherein said hydraulic means comprises a tube connecting the head end of one hydraulic piston with the rod end of the other hydraulic piston and a second tube connecting the rod end of said one hydraulic piston with the head end of said other hydraulic piston.

5. A tractor as claimed in claim 1 wherein means are provided in the middle chamber for cushioning limited excessive movements of said rod and a stop is provided in said one end chamber aligned with said rod to limit excessive movement of said rod against said cushioning means.

6. A tractor as claimed in claim 5 wherein said means in said middle chamber comprises a disc surrounding said rod, resilient means between said disc and the apertured wall defining the one end chamber, and a shoulder formed on said rod which will engage with said disc to compress said resilient means in said middle chamber under said limited excessive movement of said rod.

7. In a tractor, a bulldozer blade, a push frame having a pair of arms, each arm connecting said bulldozer blade to said tractor, in combination, a linkage extending between the push frame and an upper portion of said blade, said linkage comprising a pair of links with each link having a cylinder, each cylinder having a cap at one end portion thereof and an apertured cap closing off the other end portion thereof, said cap having an eye pinned to one arm of said push frame, a pair of spaced apart apertured walls fixed in said cylinder and dividing the cavity in said cylinder into three separate chambers, a rod connected at one end to said upper portion of said blade and extending through said apertured cap into said cavity, said rod having two spaced apart pistons secured thereto with a cushioning piston in one end chamber and a hydraulic piston in the other end chamber, resilient means nested in said one end chamber between said cap and said cushioning piston, additional resilient means nested between said cushioning piston and one of said fixed walls, hydraulic means connecting a head end of said hydraulic piston in one of said cylinders with the rod end of the comparable hydraulic piston in said other cylinder, and hydraulic means connecting the rod end of said hydraulic piston with the head end of said comparable hydraulic piston in said other cylinder whereby not only will a shock load on the blade move the rod of one cylinder which will cause the fluid on the head end of the hydraulic piston in that cylinder to be forced to the rod end of the comparable hydraulic piston in the other cylinder which, in turn, will force fluid on the head end of said comparable hydraulic piston back to the rod end of the hydraulic piston in the first cylinder to stabilize said blade but also said resilient means will cushion any movement of said cushioning piston.

8. In a tractor as claimed in claim 7 wherein said resilient means comprises a plurality of stacked together resilient discs positioned between said cap and said cushioning piston and said additional resilient means comprises a plurality of stacked together resilient discs positioned between said cushioning piston and said one fixed wall.

9. In a tractor as claimed in claim 7 wherein means are provided in the middle chamber to cushion excessive movements of said rod.

10. In a tractor as claimed in claim 9 wherein said means comprises a disc on said rod, resilient means between said disc and said fixed wall defining said one end chamber, and a shoulder on said rod engageable with said disc to cushion excessive movement of said rod.

11. In a tractor as claimed in claim 10 wherein a stop is provided in said one end chamber engageable with said rod to stop movement of said rod in a direction toward said cap.

12. In a cushion link hydraulic stabilizer for a bulldozer blade, a tractor having a track roller frame, a push frame connected to said track roller frame, a bulldozer blade connected to said push frame at the opposite end thereof, said cushion link hydraulic stabilizer extending at an angle between said push frame and said blade and comprising a pair of links, each link having a cylinder, each cylinder having a connecting eye extending from one end portion thereof with the other end portion closed off by an apertured cap, said eye being pinned to one arm of said push frame, a pair of spaced apart apertured walls fixed in said cylinder and dividing the cavity in said cylinder into three separate chambers, a rod extending through said apertured cap into said cavity, the exterior end of said rod being pinned to an upper corner of said blade, said rod having two pistons secured thereto with one piston in one end chamber and the other piston in the other end chamber, resilient means in said one end chamber between both sides of said piston and the end walls of said chamber for cushioning said piston, means connecting one side of said other piston in said cylinder with the opposite side of the comparable piston in said other cylinder, and means connecting the other side of said other piston with the opposite side of the comparable piston in said other cylinder whereby movement of one rod will cause the fluid on one side of the piston to be forced to the opposite side of the comparable piston which, in turn, will force fluid on the other side of said piston back to the other side of the first piston to stabilize said pistons and whereby said resilient means will cushion any movement of said rods.

13. A vehicle having an implement with lower corners, a push frame having a pair of push arms, each push arm being connected to said vehicle and to a lower corner of said implement, a link extending between each push arm and an upper corner of said implement, each link having a cylinder with a cavity, a pair of spaced apart apertured walls in said cylinder dividing the cavity into three separate chambers, a rod extending into said cavity, said rod having a cushioning piston and a hydraulic piston secured thereto with the cushioning piston disposed in one end chamber and the hydraulic piston disposed in the other end chamber, cushioning means in said one end chamber for cushioning loads applied to said rod by said implement, hydraulic means connecting the head ends and rod ends of the respective hydraulic pistons in series whereby excess loads on the rod of one link will be transmitted through the hydraulic means to the hydraulic piston in the other link to stabilize the loads received by the links from the implement.

* * * * *